US010195882B2

(12) United States Patent
Tamai

(10) Patent No.: US 10,195,882 B2
(45) Date of Patent: Feb. 5, 2019

(54) PRINTING APPARATUS

(71) Applicant: SEIKO EPSON CORPORATION, Tokyo (JP)

(72) Inventor: Satoshi Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/846,981

(22) Filed: Dec. 19, 2017

(65) Prior Publication Data

US 2018/0178569 A1 Jun. 28, 2018

(30) Foreign Application Priority Data

Dec. 27, 2016 (JP) ..... 2016-254074

(51) Int. Cl.

| | |
|---|---|
| ***B41J 29/02*** | (2006.01) |
| ***B41J 29/56*** | (2006.01) |
| ***B41J 29/13*** | (2006.01) |
| ***B41J 2/175*** | (2006.01) |

(52) U.S. Cl.

CPC ..... *B41J 29/56* (2013.01); *B41J 2/1752* (2013.01); *B41J 2/17523* (2013.01); *B41J 29/02* (2013.01); *B41J 29/13* (2013.01)

(58) Field of Classification Search

CPC ..... B41J 2/175; B41J 2/17509; B41J 2/1752; B41J 2/17523; B41J 2/17553; B41J 2/17554; B41J 29/02; B41J 29/17513; B41J 2/17556

See application file for complete search history.

(56) References Cited

U.S. PATENT DOCUMENTS

| | | | | |
|---|---|---|---|---|
| 5,526,226 | A | 6/1996 | Katoh et al. | |
| 6,059,396 | A * | 5/2000 | Choi | B41J 2/01 347/37 |
| 6,655,793 | B2 * | 12/2003 | Jones | B41J 2/1752 347/85 |
| 7,524,016 | B2 * | 4/2009 | Silverbrook | B41J 2/14427 347/29 |
| 9,505,224 | B2 * | 11/2016 | Kimura | B41J 2/17509 |

(Continued)

FOREIGN PATENT DOCUMENTS

| | | |
|---|---|---|
| JP | 07-036563 | 2/1995 |
| JP | 08-339240 | 12/1996 |

(Continued)

OTHER PUBLICATIONS

European Search Report issued in Application No. 17206697 dated Apr. 19, 2018.

*Primary Examiner* — Anh T. N. Vo

(74) *Attorney, Agent, or Firm* — Workman Nydegger

(57) ABSTRACT

An ink jet printer includes: a print section; a container that houses a print associated member; an insertion port into which the container is inserted; an openable cover that openably covers a front surface of the insertion port; and a lock mechanism that locks the openable cover. The lock mechanism includes a through hole provided in the openable cover, and a displacement member provided in a cover-adjacent portion and configured to move between a locked position in which it engages the through hole to regulate opening movement of the openable cover and an unlocked position in which it disengages from the through hole to permit opening movement of the openable cover.

9 Claims, 7 Drawing Sheets

(56) References Cited

U.S. PATENT DOCUMENTS

| | | | |
|---|---|---|---|
| 2010/0320884 | A1 | 12/2010 | Shiroishi et al. |
| 2015/0258826 | A1 | 9/2015 | Iwaya et al. |
| 2016/0263901 | A1 | 9/2016 | Kudo et al. |

FOREIGN PATENT DOCUMENTS

| | | |
|---|---|---|
| JP | 2011-002935 | 1/2011 |
| JP | 2011-150708 | 8/2011 |
| JP | 2015-044371 | 3/2015 |
| JP | 2016087913 | 5/2016 |

* cited by examiner

PRINTING APPARATUS

CROSS REFERENCES TO RELATED APPLICATIONS

The entire disclosure of Japanese Patent Application No. 2016-254074, filed Dec. 27, 2016 is expressly incorporated by reference herein.

BACKGROUND

1. Technical Field

The present disclosure relates to printing apparatuses such as ink jet printers.

2. Related Art

In general, printing apparatuses known in the art include ink jet printers that perform printing by ejecting ink from a recording head onto a medium such as a paper sheet while the ink is supplied from an ink containing member. As disclosed in JP-A-2015-44371, such printers include a printer that includes a container main body having a bottomed box shape which houses an ink containing member, a rotatable cover configured to open and close an opening of the container main body, and a lock mechanism that holds the cover in a closed state.

The lock mechanism includes two plate-shaped members having a through hole, and one of the two plate-shaped members is disposed on the cover and the other is disposed on the container main body. When the cover is in a closed state, two plate-shaped members engage each other and the through holes communicate with each other. The cover is held in the closed state by being locked by a padlock having an arm inserted into the through holes of the two plate-shaped members.

The above lock mechanism of the printer does not have ease of operation since locking by using a padlock is required to regulate opening movement of the cover.

SUMMARY

The disclosure has been made by focusing on such problems present in the conventional art. An advantage of some aspects of the disclosure is that a printing apparatus having an improved convenience of operation of the lock mechanism for locking a containing member that houses print associated members is provided.

The following describes means for solving the above problem and the advantageous effect thereof. According to an aspect of the disclosure, a printing apparatus includes: a print section that performs printing on a medium; an insertion port into which a containing member that contains a print associated member which is associated with printing by the print section is inserted; an openable cover that openably covers a front surface of the insertion port; and a lock mechanism that locks the openable cover, wherein the lock mechanism includes: an engaging section disposed on one of the openable cover and an exterior part surrounding the openable cover; and a displacement member disposed on the other, and configured to move between a locked position in which it engages the engaging section to regulate opening movement of the openable cover and an unlocked position in which it disengages from the engaging section to permit opening movement of the openable cover.

With this configuration, opening movement of the openable cover can be regulated only by displacing the displacement member to the locked position while the openable cover is closed without a need of the padlock to thereby lock the containing member that houses the print associated member. Therefore, operating convenience of the lock mechanism for locking the containing member that houses the print associated member can be improved.

In the above printing apparatus, it is preferred that the displacement member includes an attachment section for attaching the regulation member that regulates movement of the displacement member to the unlocked position, and the attachment section is exposed when the displacement member is positioned at the locked position and at least part of the attachment section is housed in the other when the displacement member is positioned at the unlocked position.

With this configuration, by attaching a regulation member to the attachment section which is exposed when the displacement member is positioned at the locked position, a third party cannot freely open the openable cover.

It is preferred that the above printing apparatus includes a displacement regulation section that regulates displacement of the displacement member to the locked position in the open state of the openable cover. With this configuration, since the displacement member is not positioned at the locked position in the open state of the openable cover, the openable cover or an adjacent portion can be prevented from colliding with the displacement member during closing of the openable cover.

In the above printing apparatus, it is preferred that the displacement member displaces in the direction perpendicular to the open/close direction of the openable cover. With this configuration, since the displacement member can be advantageously engaged with the engaging section, opening movement of the openable cover can be effectively regulated by the displacement member.

In the above printing apparatus, it is preferred that the displacement member is disposed on the exterior part surrounding the openable cover. With this configuration, the displacement member does not need to be disposed on the openable cover, thereby contributing to reduction in size and weight of the openable cover.

In the above printing apparatus, it is preferred that the displacement member includes an operation section which is operated to displace the displacement member, and the other includes a first movement regulation section that regulates movement of the operation section at a position in which the displacement member has been displaced to the locked position, and a second movement regulation section that regulates movement of the operation section at a position in which the displacement member has been displaced to the unlocked position.

With this configuration, the displacement member can be easily and accurately displaced between the locked position and the unlocked position by operating the operation section. In the above printing apparatus, it is preferred that the attachment section is a pair of openings communicating with each other through which the regulation member can be inserted.

With this configuration, a regulation member of a type that is partially inserted into a pair of openings (for example, a wire lock or a padlock) can be attached. In the above printing apparatus, it is preferred that the pair of the openings communicate each other in a linear shape.

With this configuration, a regulation member of a type that is partially inserted into a pair of openings (for example, a wire lock or a padlock) can be easily attached. According to another aspect of the disclosure, a printing apparatus includes: a print section that performs printing on a medium; a containing member that houses a print associated member which is associated with printing by the print section and is detachably mounted to an apparatus main body; and a lock mechanism that regulates pulling-out movement of the containing member, wherein the lock mechanism includes: an engaging section disposed on one of the containing member and an exterior part surrounding the containing member; and a displacement member disposed on the other, and configured to move between a locked position in which it engages with the engaging section to regulate the pulling-out movement of the containing member and an unlocked position in which it disengages from the engaging section to permit the pulling-out movement of the containing member, and the displacement member includes an attachment section for attaching the regulation member that regulates movement of the displacement member to the unlocked position, and the attachment section is exposed when the displacement member is positioned at the locked position and at least part of the attachment section is housed in the other when the displacement member is positioned at the unlocked position.

With this configuration, the containing member that houses the print associated member can be locked without a need of a lock only by displacing the displacement member to the locked position. In addition, by attaching a regulation member to the attachment section which is exposed when the displacement member is positioned at the locked position, a third party cannot freely pull out the containing member. Therefore, operating convenience of the lock mechanism for locking the containing member that houses the print associated member can be improved.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
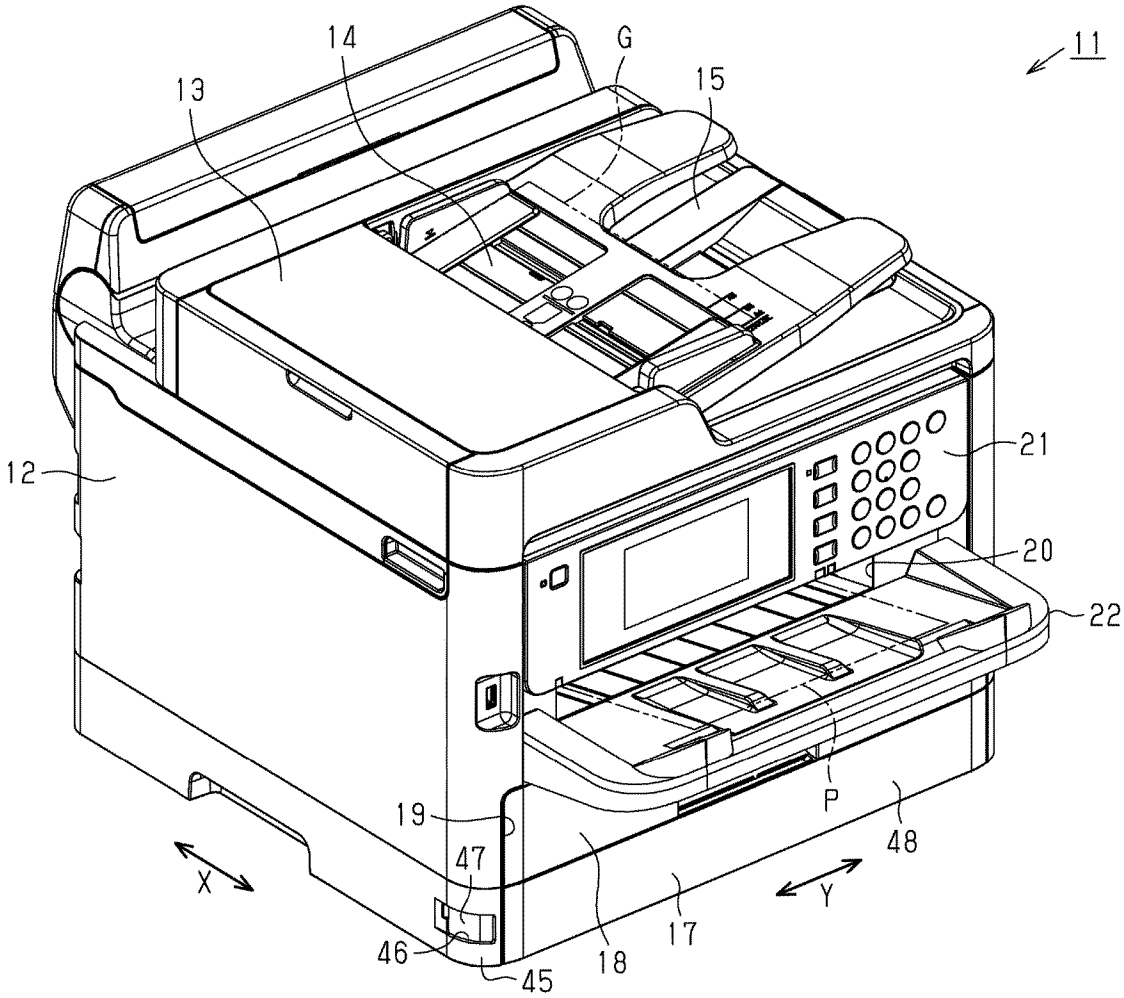
FIG. 1 is a perspective view of an ink jet printer according to an embodiment.

With reference to the drawings, an embodiment of a printing apparatus implemented as an ink jet printer will be described below. As shown in FIG. 1, an ink jet printer 11 which is an example of the printing apparatus (apparatus main body) includes a housing 12 having predetermined height, depth, and width when placed on a horizontal plane for use, and a document reading apparatus which includes an automatic document feeder 13 disposed on the housing 12.

The automatic document feeder 13 includes a setting section 14 on which a plurality of documents G are set in a stacked state, and an output unit 15 disposed under the setting section 14. As each of the plurality of documents G set in a stacked state in the setting section 14 are fed out to the output unit 15 in a sequential manner while being inverted through a document feeding path (not shown in the figure), the documents G are read by a reading section 16 (see FIG. 2) disposed on an upper end of the housing 12.

On the front surface of the housing 12, an openable cover 17, a mounting port 19 through which a paper sheet cassette 18 that houses paper sheets P as an example of a medium is detachably mounted, an output port 20 through which the printed paper sheet P is outputted, and an operation section 21 with which various operations are performed are disposed from the bottom to the top. Further, an output tray 22 for supporting the printed paper sheet P outputted from the output port 20 is detachably mounted on the front surface of the housing 12, protruding forward therefrom. The front surface of the housing 12 refers to a side surface having a height and a width, on which a user mainly performs an operation of the ink jet printer 11.

Figure 2:
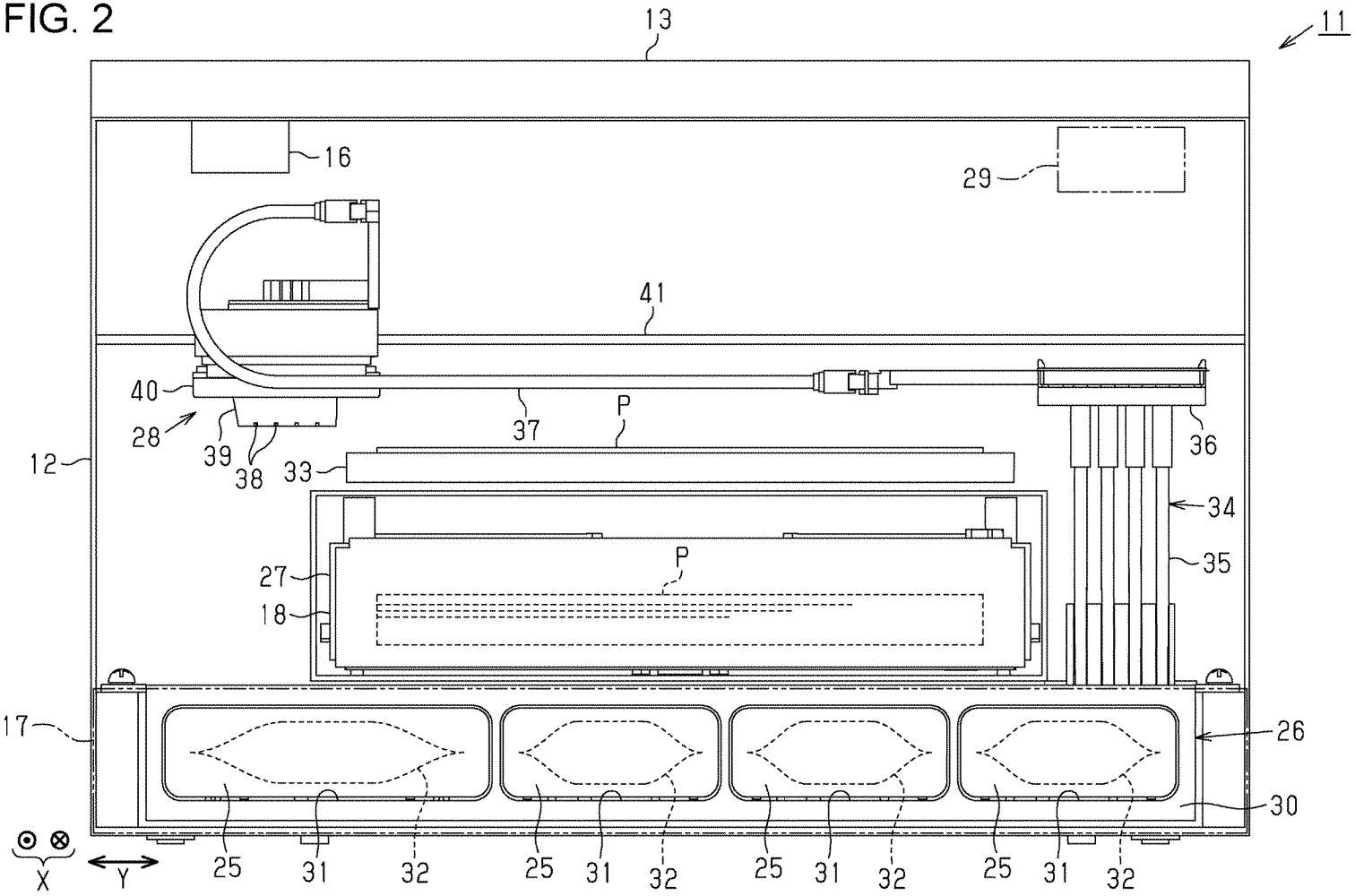
FIG. 2 is a front schematic view of an inner structure of the ink jet printer.

As shown in FIGS. 1 and 2, the housing 12 includes an mounting section 26 to which a container 25 which is an example of a containing member is detachably mounted, a paper sheet container 27 which is a portion that houses the paper sheets P in the paper sheet cassette 18, and a print section 28 that performs printing on the paper sheet P, which are disposed at positions on the backside of the openable cover 17, the mounting port 19, and the operation section 21, respectively. The openable cover 17 openably covers the front surface of the mounting section 26. Further, the ink jet printer 11 includes a control section 29 at an arbitrary position in the housing 12 to integrally control the overall ink jet printer 11.

As shown in FIG. 2, the mounting section 26 includes a frame 30 that forms a housing space for housing one or more (in this embodiment, four) containers 25. The frame 30 forms four insertion ports 31 that communicate with the housing space from the front side. The four containers 25 are detachably mounted to the mounting section 26 when inserted into the housing space through the corresponding one of the four insertion ports 31. The front surfaces of the four insertion ports 31 are openably covered by the openable cover 17.

Further, in the present embodiment, the container 25 is removably inserted into the insertion port 31. The direction in which the container 25 is inserted into the insertion port 31 is a depth direction X, and the direction perpendicular to the depth direction X is a width direction Y. The width direction Y and the depth direction X extend substantially along the horizontal surface. The four insertion ports 31 are arranged in the width direction Y.

Each container 25 is formed as a substantially cuboid shape, and houses a flexible bag 32 that houses ink as an example of a print associated member, which is associated with printing performed by the print section 28. Each bag 32 housed in each of the four containers 25 stores different colors of ink (in this embodiment, black, cyan, magenta, and yellow).

In this case, since black ink is frequently used, the bag 32 that houses black ink and the container 25 that houses this bag 32 have a larger width than the bags 32 that house ink other than black ink and the containers 25 that house these bags 32. In this embodiment, the container 25 that houses the bag 32 that houses black ink is inserted into the insertion port 31 located on the left end in FIG. 2. Further, the widths of the insertion ports 31 are each determined depending on the widths of the containers 25 to be inserted.

A support table 33 that supports the paper sheet P is disposed on the upper side of the paper sheet container 27 in the housing 12. A plurality of paper sheets P housed in a stacked state in the paper sheet container 27 are sequentially inverted and transported to the support table 33 by a transportation unit (not shown in the figure). Further, a supplying mechanism 34 is housed in the housing 12. The supplying mechanism 34 supplies ink in the container 25 mounted in the mounting section 26 to the print section 28 by driving a supply pump (not shown in the figure).

The supplying mechanism 34 includes a supplying tube 35 having one end connected to the mounting section 26, a joint 36 connected to the other end of the supplying tube 35, and a flexible tube 37 having one end connected to the joint 36 and the other end connected to the print section 28. Four supplying mechanisms 34 are disposed in the housing 12 so as to correspond to four containers 25.

The print section 28 includes a recording head 39 having a plurality of nozzles 38 that eject ink supplied from each of the containers 25 via each of the supplying mechanisms 34, and a carriage 40 that supports the recording head 39. The carriage 40 is reciprocatively supported by a guide shaft 41 extending in the width direction Y in the housing 12. That is, the carriage 40 reciprocates in the width direction Y.

While the carriage 40 reciprocates in the width direction Y along the guide shaft 41, ink is ejected from the nozzles 38 of the recording head 39 onto the paper sheet P transported on the support table 33 to thereby perform printing on the paper sheet P. In this case, the respective flexible tubes 37 deform in accordance with reciprocation of the carriage 40. Further, as shown in FIG. 1, the printed paper sheet P is outputted from the output port 20 onto the output tray 22.

As shown in FIG. 1, a portion of the housing 12 which is adjacent to the openable cover 17 (in FIG. 1, a portion located on the left side of the openable cover 17 as viewed from the front surface of the housing 12) is referred to as a cover-adjacent portion 45, which is an example of an exterior part surrounding the openable cover 17. The cover-adjacent portion 45 is located at a corner of the housing 12. The cover-adjacent portion 45 has an opening 46 having a substantially rectangular shape which extends along a curvature of the corner of the housing 12.

A displacement member 47 is movably disposed in the cover-adjacent portion 45 so as to be exposed through the opening 46.

Figure 3:
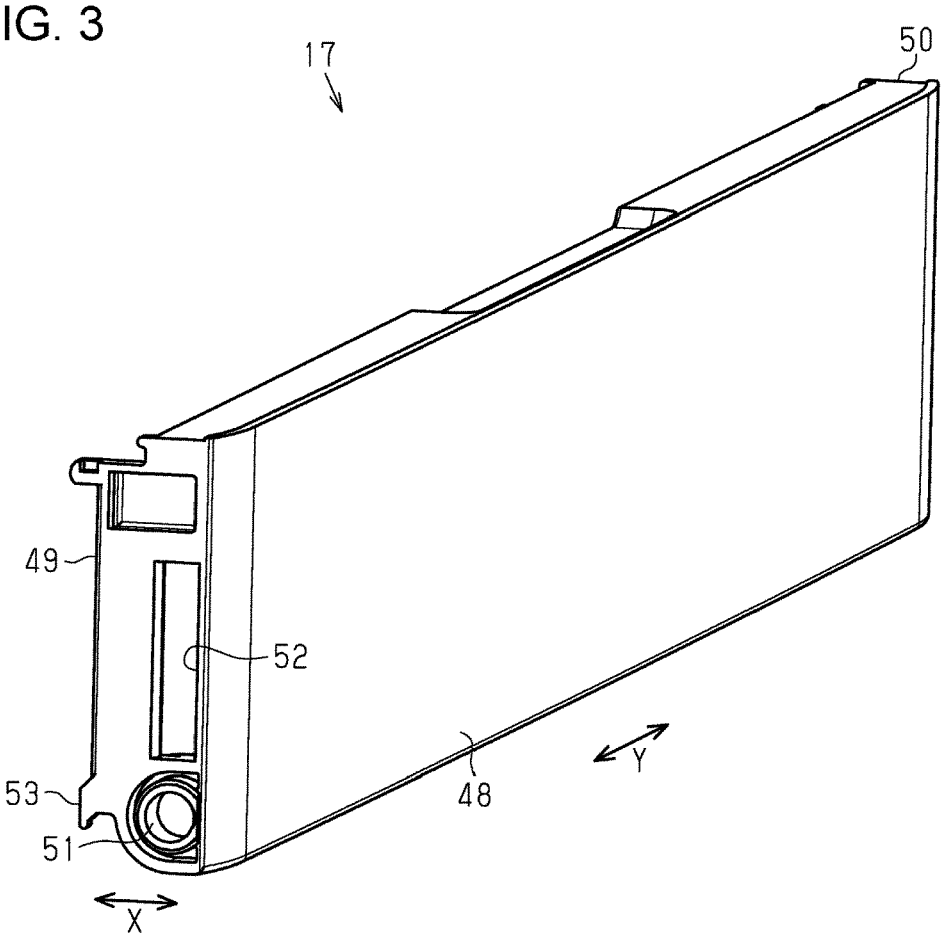
FIG. 3 is a perspective view of an openable cover of the ink jet printer.

As shown in FIGS. 1 and 3, the openable cover 17 is formed in a bottomed rectangular box-shape having a longer dimension in the width direction Y, and is configured such that only the bottom wall 48 that extends along the vertical plane is exposed when closed (the state shown in FIGS. 1 and 3). Of two side walls of the openable cover 17 opposed in the width direction Y, one located closed to the cover-adjacent portion 45 is referred to as a first side wall 49, while the other located opposite to the cover-adjacent portion 45 is referred to as a second side wall 50.

In the closed state of the openable cover 17, a pair of annular bearing sections 51 are formed to penetrate the lower end of the first side wall 49 and the second side wall 50. At the pair of bearing sections 51, a pair of shafts (not shown in the figure) which protrudes in the width direction Y from positions corresponding to each of the pair of bearing sections 51 in the housing 12 is each inserted into the corresponding one of the pair of bearing sections 51.

The openable cover 17 is rotatably supported by a pair of shafts (not shown in the figure) at the pair of bearing sections 51. That is, the openable cover 17 is rotatable about the axis extending in the width direction Y (a center axis of the bearing section 51) at the pair of bearing sections 51 between a closed position in which the bottom wall 48 is located along the vertical plane (position shown in FIG. 1) and an open position (position shown in FIG. 12) in which the bottom wall 48 has been rotated from the closed position by 90 degrees and is located along the horizontal plane.

A through hole 52 of a rectangular shape, which is an example of an engaging section, is formed at a position adjacent to and on the upper side of the bearing section 51 in the first side wall 49 in the state of the closed position of the openable cover 17, and a displacement regulation section 53 is formed at a position adjacent to and on the back side of the bearing section 51 in the first side wall 49 (on the side opposite to the bottom wall 48) so as to protrude backward. As the openable cover 17 rotates from the closed position to the open position, the displacement regulation section 53 moves to the position of the through hole 52 when the openable cover 17 is at the closed position.

Figure 4:
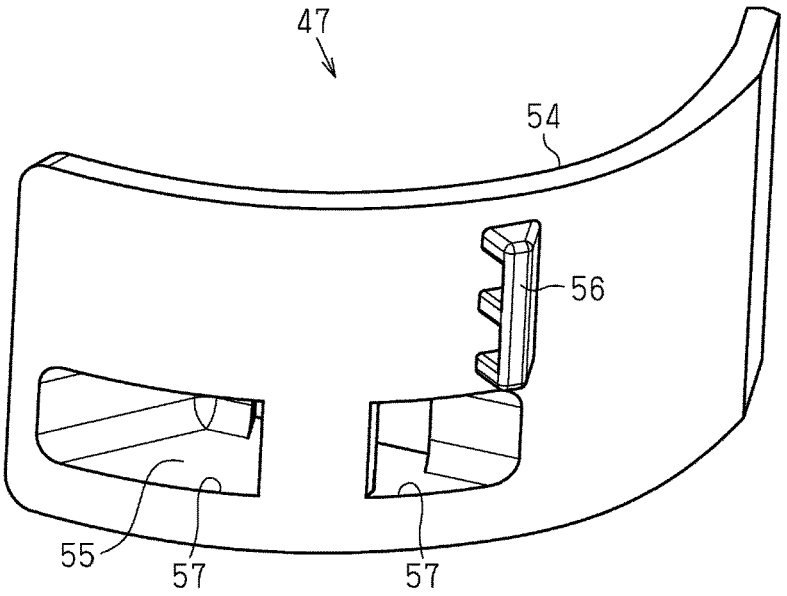
FIG. 4 is a perspective view of a displacement member of the ink jet printer.

As shown in FIGS. 1 and 4, the displacement member 47 is reciprocatable (displaceable) along a curvature of a corner of the housing 12, and includes a main body 54 having a strip shape which curves along a corner of the housing 12 and a horizontal portion 55 having a substantially fan shape which horizontally extends on the lower end of the main body 54 on the end opposite to the openable cover 17.

A finger hook 56, which is an example of an operation section on which a user's finger is hooked in moving of the displacement member 47, is formed at the center of the main body 54 in the longitudinal direction. That is, the finger hook 56 is operated by a user to displace the displacement member 47 along the longitudinal direction. In this case, the distal end of the finger hook 56 is preferably located on the same plane as the outer surface of the housing 12 or slightly inside the outer surface of the housing 12. Further, in this case, the displacement member 47 is displaced in the direction intersecting an open/close direction (preferably, a direction perpendicular to the open/close direction), which is a direction in which the openable cover 17 rotates between the closed position and the open position.

A pair of openings 57 are formed side by side in the longitudinal direction of the main body 54 on the upper side of the horizontal portion 55 of the main body 54. The pair of openings 57 linearly communicates with each other on the upper side of the horizontal portion 55. That is, the pair of openings 57 can be linearly connected to each other on the upper side of the horizontal portion 55.

Further, the pair of openings 57 allows, for example, an arm 60*a* of a padlock 60 (see FIG. 11) or a wire of a wire lock to pass therethrough. That is, the regulation member such as the padlock 60 (see FIG. 11) or a wire lock can be attached to the pair of openings 57. In this embodiment, an attachment section for attaching a lock to the displacement member 47 to regulate displacement of the displacement member 47 is formed by the pair of openings 57.

Figure 5:
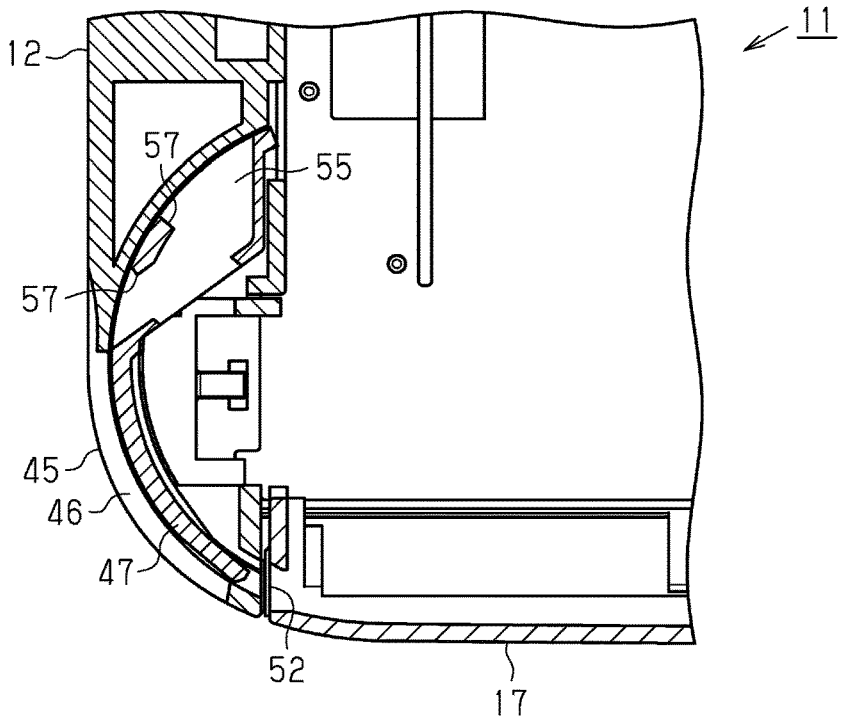
FIG. 5 is an enlarged plan cross-sectional view of an essential part of the displacement member when positioned at an unlocked position.
Figure 6:
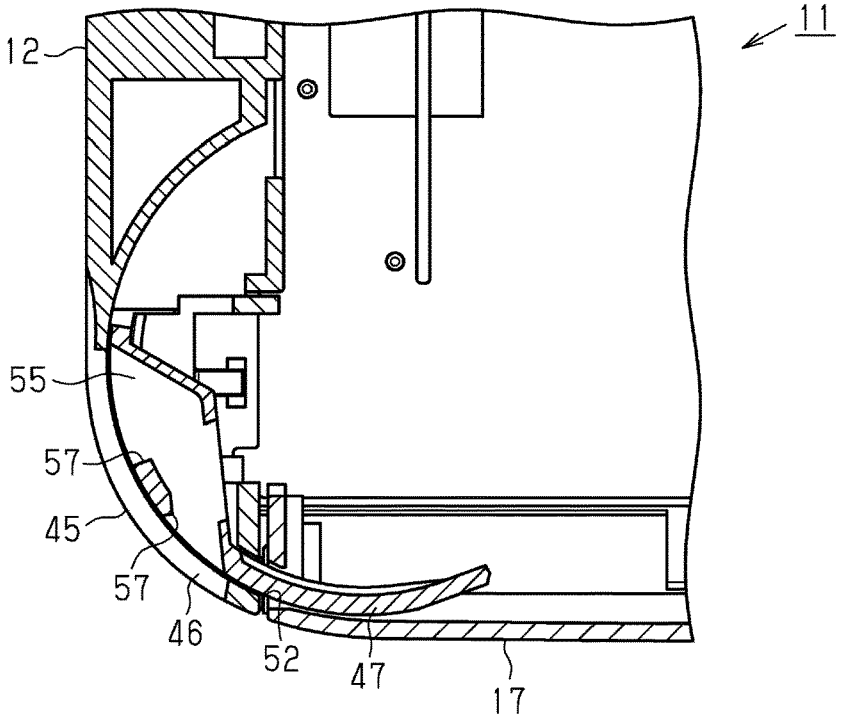
FIG. 6 is an enlarged plan cross-sectional view of an essential part of the displacement member when positioned at a locked position.
Figure 7:
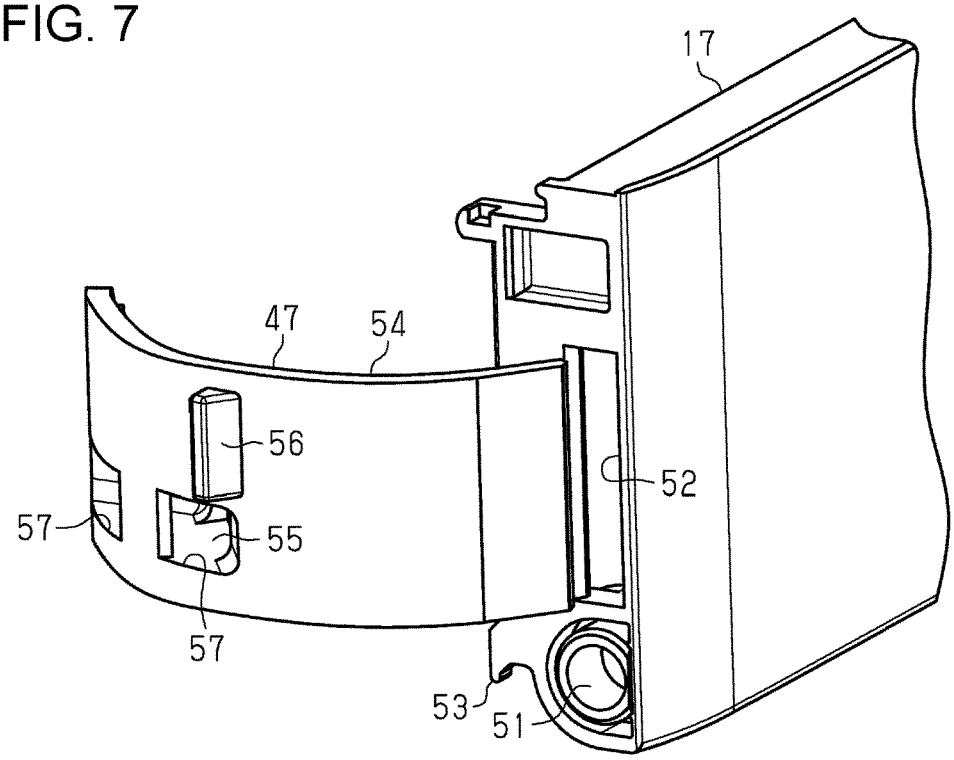
FIG. 7 is a perspective view which illustrates a positional relationship between the displacement member and the openable cover of FIG. 5.
Figure 8:
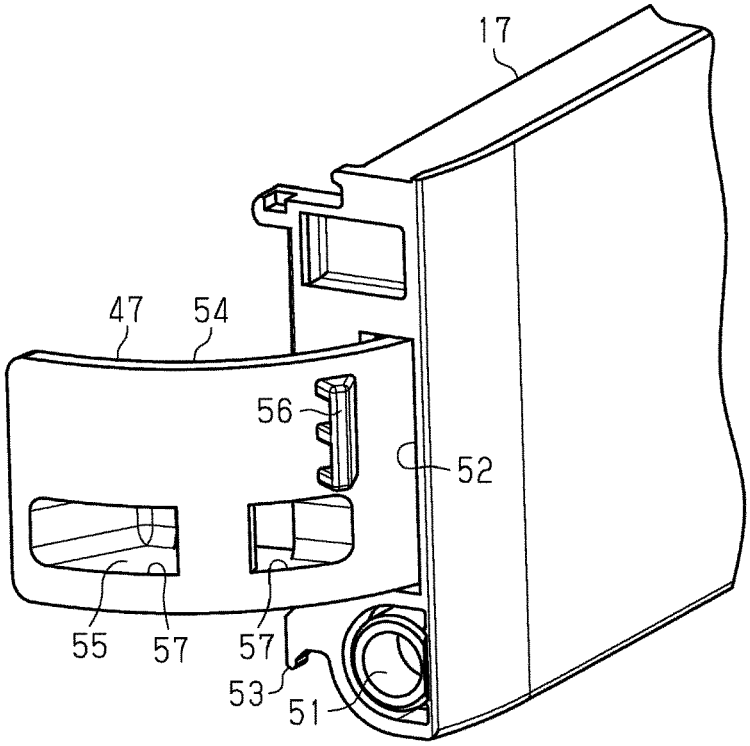
FIG. 8 is a perspective view which illustrates a positional relationship between the displacement member and the openable cover of FIG. 6.

The displacement member 47 moves between a locked position (position shown in FIGS. 6 and 8) in which it engages with the through hole 52 of the openable cover 17 positioned in the closed position to regulate opening movement of the openable cover 17 (rotation from the closed position to the open position) and an unlocked position (position shown in FIGS. 5 and 7) in which it disengages from the through hole 52 to permit opening movement of the openable cover 17.

That is, the displacement member 47 reciprocates between the locked position in which it is partially inserted into the through hole 52 of the openable cover 17 positioned in the closed position to regulate opening movement of the openable cover 17 and the unlocked position in which it is withdrawn from the through hole 52 to permit opening movement of the openable cover 17. That is, the displacement member 47 displaces along the side surface (front surface) of the housing 12 on which the openable cover 17 is provided and the side surface (left side surface to the front surface in FIG. 1) adjacent to the aforementioned side surface (front surface).

Figure 9:
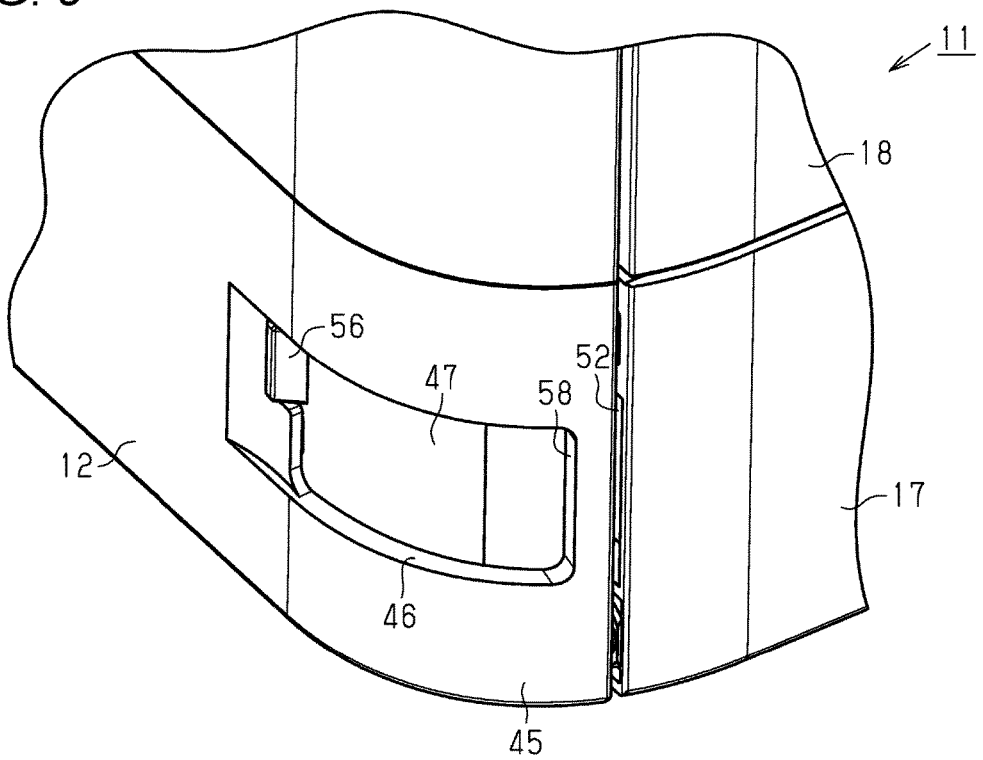
FIG. 9 is an enlarged perspective view of an essential part which shows that the displacement member is positioned at an unlocked position.
Figure 10:
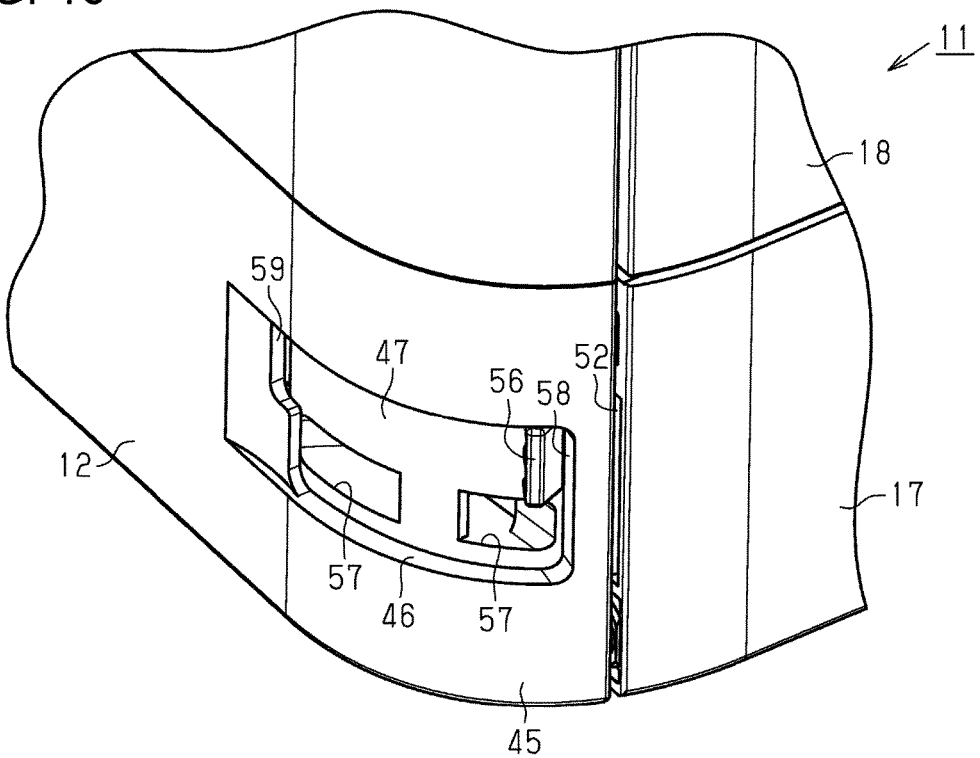
FIG. 10 is an enlarged perspective view of an essential part which shows that the displacement member is positioned at a locked position.

Further, the displacement member 47 is configured such that the pair of openings 57 is substantially entirely exposed through the opening 46 of the cover-adjacent portion 45 as shown in FIG. 10 when positioned in the locked position, and the pair of openings 57 is substantially entirely housed in the cove-adjacent portion 45 as shown in FIG. 9 when positioned in the unlocked position. In the present embodiment, a lock mechanism that locks the openable cover 17 at the closed position is formed by the displacement member 47 and the through hole 52 of the openable cover 17.

As shown in FIGS. 9 and 10, the cover-adjacent portion 45 includes a first movement regulation section 58 that regulates movement of the finger hook 56 at the position in which the displacement member 47 has been displaced to the locked position, and a second movement regulation section 59 that regulates movement of the finger hook 56 at the position in which the displacement member 47 has been displaced to the unlocked position. In the present embodiment, the first movement regulation section 58 is formed by an end of the opening 46 located close to the openable cover 17, and the second movement regulation section 59 is formed by an end of the opening 46 located opposite to the openable cover 17.

Accordingly, the displacement member 47 is displaced to the locked position by having the finger hook 56 abut the first movement regulation section 58 and the displacement member 47 is displaced to the unlocked position by having the finger hook 56 abut the second movement regulation section 59. That is, the first movement regulation section 58 and the second movement regulation section 59 serve as a stopper for the finger hook 56.

Figure 12:
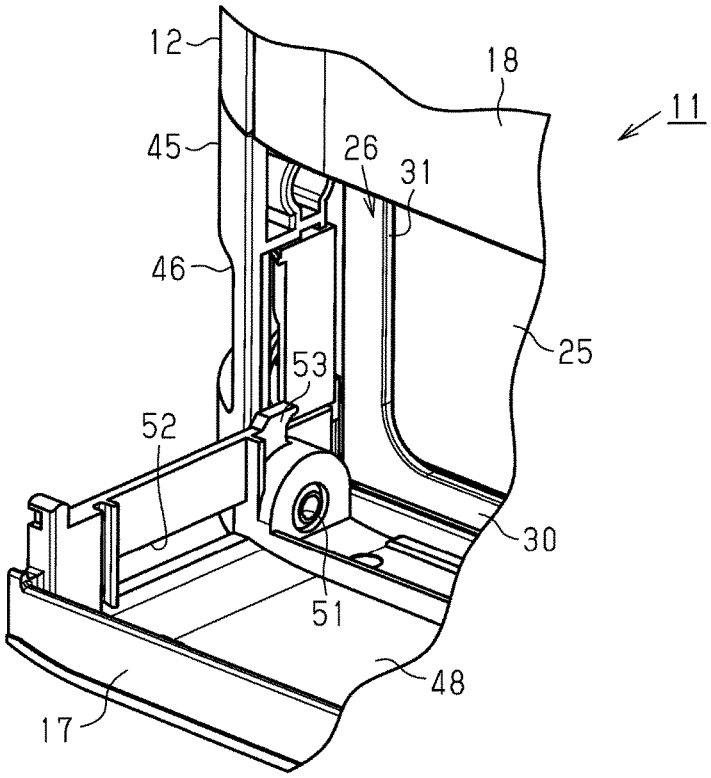
FIG. 12 is an enlarged perspective view of an essential part which shows that the openable cover is positioned at an open position in the ink jet printer of FIG. 1.

Next, an effect of the ink jet printer 11 when in use will be described. As shown in FIGS. 9 and 10, for exchange of the bag 32 in the container 25 mounted in the mounting section 26, the displacement member 47 is moved from the locked position to the unlocked position by moving the finger hook 56 to abut against the second movement regulation section 59 to thereby release the lock state of the openable cover 17 by the displacement member 47. Then, as shown in FIG. 12, the openable cover 17 is rotated from the closed position to the open position to thereby expose the mounting section 26. Then, the container 25 is pulled out through the insertion port 31, and the bag 32 in the container 25 is replaced with a new one. After that, the container 25 is again inserted through the insertion port 31 and is mounted in the mounting section 26.

If the displacement member 47 is attempted to be moved from the unlocked position to the locked position with the openable cover 17 being positioned at the open position (open state of the openable cover 17), displacement of the displacement member 47 to the locked position is regulated by the displacement regulation section 53. That is, since the displacement regulation section 53 is located on the path in which the displacement member 47 moves from the unlocked position to the locked position, displacement of the displacement member 47 to the locked position is prohibited by the displacement regulation section 53.

Then, the mounting section 26 is covered with the openable cover 17 by rotating the openable cover 17 from the open position to the closed position. Then, the displacement member 47 is moved from the unlocked position to the locked position by moving the finger hook 56 to abut against the first movement regulation section 58 to thereby lock the openable cover 17 by the displacement member 47. Accordingly, rotation movement of the openable cover 17 from the closed position to the open position is regulated by the displacement member 47.

Figure 11:
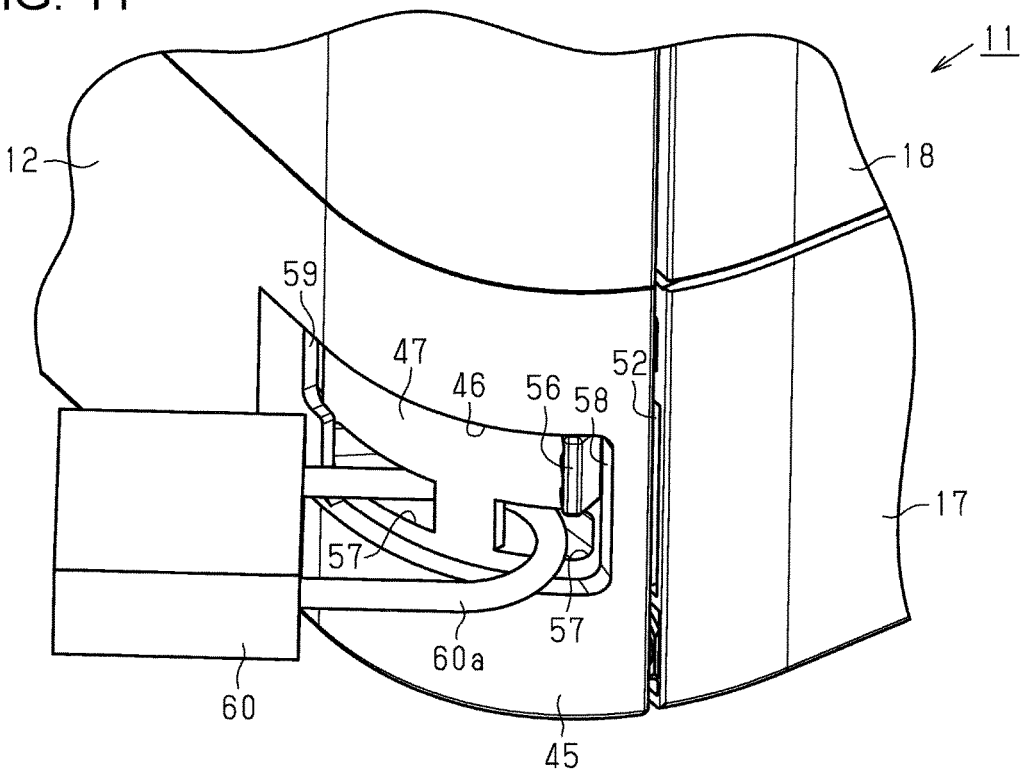
FIG. 11 is an enlarged perspective view of an essential part which shows that a padlock is attached to the displacement member of FIG. 10.

Subsequently, as shown in FIG. 11, the arm 60*a* of the padlock 60 which is an example of the regulation member is inserted into the pair of openings 57 of the displacement member 47, and the padlock 60 is locked so that the displacement member 47 becomes the locked state.

Accordingly, movement of the displacement member 47 from the locked position to the unlocked position is regulated by the padlock 60. As a result, since a third party cannot easily freely open the openable cover 17, the container 25 mounted in the mounting section 26 is prevented from being replaced or stolen without permission.

According to the embodiment described above in detail, the following advantageous effects can be obtained. (1) In the ink jet printer 11, the lock mechanism includes the through hole 52 provided in the openable cover 17, and the displacement member 47 provided in the cover-adjacent portion 45 and configured to move between the locked position in which it engages the through hole 52 to regulate opening movement of the openable cover 17 and the unlocked position in which it disengages from the through hole 52 to permit opening movement of the openable cover 17. Accordingly, opening movement of the openable cover 17 can be regulated only by displacing the displacement member 47 to the locked position while the openable cover 17 is closed without a need of the padlock 60. Therefore, operating convenience of the lock mechanism for locking the openable cover 17 that locks opening and closing of the front surface of the insertion port 31 in which the container 25 that stores ink is inserted can be improved.

(2) In the ink jet printer 11, the displacement member 47 includes a pair of openings 57 for attaching the padlock 60 that regulates movement of the displacement member 47 to the unlocked position. The pair of openings 57 is substantially entirely exposed when the displacement member 47 is positioned at the locked position, and the pair of opening 57 is substantially entirely covered by the cover-adjacent portion 45 when the displacement member 47 is positioned at the unlocked position. Accordingly, by attaching the padlock 60 for locking to the pair of openings 57 which are exposed when the displacement member 47 is positioned at the locked position, a third party cannot freely open the openable cover 17. In addition, since the pair of openings 57 are substantially entirely housed in the cover-adjacent portion 45 when the displacement member 47 is positioned at the unlocked position, movement of the displacement member 47 to the unlocked position can be regulated by the padlock 60 regardless of the length of the arm 60*a* of the padlock 60 attached to the pair of opening 57. If a length of the arm of the padlock is long in the lock mechanism described in JP-A-2015-44371, the cover is opened to a certain extent even if it is locked by using a padlock.

(3) The ink jet printer 11 includes the displacement regulation section 53 that regulates displacement of the displacement member 47 to the locked position in the open state of the openable cover 17. Accordingly, since the displacement member 47 is not positioned at the locked position in the open state of the openable cover 17, the openable cover 17 is prevented from colliding with the displacement member 47 during closing of the openable cover 17.

(4) In the ink jet printer 11, the displacement member 47 displaces in the direction perpendicular to (intersecting) the open/close direction of the openable cover 17. Accordingly, since the displacement member 47 can be advantageously engaged with the through hole 52, opening movement of the openable cover 17 can be effectively regulated by the displacement member 47.

(5) In the ink jet printer 11, the displacement member 47 is disposed on the cover-adjacent portion 45. Accordingly, the displacement member 47 does not need to be disposed on the openable cover 17, thereby contributing to reduction in size and weight of the openable cover 17.

(6) In the ink jet printer 11, the displacement member 47 includes the finger hook 56, and the cover-adjacent portion 45 includes the first movement regulation section 58 that regulates movement of the finger hook 56 at the position in which the displacement member 47 is displaced to the locked position and the second movement regulation section 59 that regulates movement of the finger hook 56 at the position in which the displacement member 47 is displaced to the unlocked position. Accordingly, the displacement member 47 can be easily and accurately displaced between the locked position and the unlocked position by moving the finger hook 56.

(7) In the ink jet printer 11, the displacement member 47 includes the pair of openings 57 communicating each other through which the arm 60*a* of the padlock 60 can be inserted. Accordingly, the padlock 60 can be reliably attached to the pair of openings 57.

(8) In the ink jet printer 11, the pair of openings 57 of the displacement member 47 linearly communicate with each other. Accordingly, since the arm 60*a* of the padlock 60 can be easily inserted into the pair of openings 57, the padlock 60 can be easily attached to the pair of openings 57.

(9) In the ink jet printer 11, the displacement member 47 is displaced along two side surfaces of the housing 12 which are adjacent to each other. Accordingly, the space of the housing 12 can be effectively used, thereby contributing to size reduction of the housing 12.

(10) In the ink jet printer 11, the displacement member 47 is configured such that the pair of openings 57 is substantially entirely housed and hided by the cover-adjacent portion 45 when positioned at the unlocked position. Accordingly, the outer appearance of the ink jet printer 11 is prevented from being affected by displacing the displacement member 47 to the unlocked position.

(11) In the ink jet printer 11, the lock mechanism (the displacement member 47 and the through hole 52) is housed inside the outer surface of the housing 12. Accordingly, the lock mechanism does not affect the outer size of the housing 12 (ink jet printer 11). That is, the lock mechanism does not cause an increase of the outer size of the housing 12 (ink jet printer 11).

Modified Examples

The above embodiment may be modified as described below.

One of a plurality of containers 25 may serve as a waste liquid tank that collects waste ink as an example of the print associated member which is generated as a result of printing by the print section 28. In this case, the waste ink is generated when flushing is performed to eject ink from the respective nozzles 38 of the recording head 39 irrespective of the printing or cleaning is performed to forcibly discharge ink in the recording head 39 from the respective nozzles 38 by using a suction pump or the like.

The lock mechanism may be configured to lock the paper sheet cassette 18 as an example of the containing member that houses the paper sheet P as an example of the print associated member. In this case, in addition to a configuration that covers the paper sheet cassette 18 that houses the paper sheet P with the openable cover 17, another configuration that locks the paper sheet cassette 18 itself by the lock mechanism without using the openable cover 17 is also possible. With this configuration, pulling-out movement of the paper sheet cassette 18 from the mounting port 19 can be regulated by the lock mechanism. Moreover, in this case, the lock mechanism regulates the pulling-out movement of the paper sheet cassette 18 when the displacement member is positioned at the locked position, and permits the pulling-out movement of the paper sheet cassette 18 when the displacement member is positioned at the unlocked position. Accordingly, by attaching a regulation member to the attachment section which is exposed when the displacement member is positioned at the locked position, a third party cannot freely pull out the paper sheet cassette 18. Therefore, operating convenience of the lock mechanism for locking the paper sheet cassette 18 that houses the paper sheet P can be improved.

The displacement member 47 of the lock mechanism may be provided on the paper sheet cassette 18 which is an example of the exterior part surrounding the openable cover 17. With this configuration, it is possible to prevent stealing of the container 25 as well as stealing of the paper sheet P by locking the lock mechanism by using the padlock 60 or the like.

In the lock mechanism, the displacement member 47 may be provided on the openable cover 17 and the through hole 52 may be provided on the cover-adjacent portion 45.

In the lock mechanism, the engaging section may be modified to a configuration other than the through hole 52 as long as it can regulate opening movement of the openable cover 17 by engaging with the displacement member 47. That is, the engaging section may be formed by a recess into which the displacement member 47 is inserted, or a hook on which the displacement member 47 is hung.

The pair of openings 57 of the displacement member 47 may not necessarily communicate each other in a linear shape.

The attachment section of the displacement member 47 may not necessarily include the pair of openings 57 into which the arm 60*a* of the padlock 60 can be inserted. That is, for example, the attachment section may be formed by a pair of recesses so that a lock can be achieved by inserting a pair of clamp pieces into the pair of recesses to be clamped thereto.

The finger hook 56 of the displacement member 47 may be omitted.

In the ink jet printer 11, at least one of the first movement regulation section 58 and the second movement regulation section 59 may be omitted.

In the ink jet printer 11, the displacement member 47 does not necessarily displace in the direction perpendicular to (intersecting) the open/close direction of the openable cover 17.

The displacement regulation section 53 of the openable cover 17 may be omitted.

The pair of openings 57 in the displacement member 47 may be omitted.

When the displacement member 47 is positioned at the unlocked position, the pair of openings 57 may not be entirely housed in the cover-adjacent portion 45. That is, when the displacement member 47 is positioned at the unlocked position, the pair of openings 57 may be partially housed in the cover-adjacent portion 45.

The medium is not limited to the paper sheet P, and may be a plastic film or the like.

The printing apparatus may be a laser printer.

What is claimed is:

1. A printing apparatus comprising:

a print section that performs printing on a medium;

an insertion port into which a containing member that contains a print associated member which is associated with printing by the print section is inserted;

an openable cover that openably covers the insertion port; and a lock mechanism that locks the openable cover, wherein the lock mechanism includes:

an insertion section disposed on one of the openable cover and an exterior part surrounding the openable cover; and a displacement member disposed on the other, and configured to move between a locked position in which the displacement member is inserted into the insertion section to regulate opening movement of the openable cover and an unlocked position in which the displacement member disengages from the insertion section to permit opening movement of the openable cover.

2. The printing apparatus according to claim 1, further comprising a displacement regulation section that regulates displacement of the displacement member to the locked position in the open state of the openable cover.

3. The printing apparatus according to claim 1, wherein the displacement member displaces in the direction perpendicular to an open/close direction of the openable cover.

4. The printing apparatus according to claim 1, wherein the displacement member is configured to displace at a corner of an exterior part surrounding the openable cover along a curvature of the corner.

5. The printing apparatus according to claim 1, wherein the displacement member is provided on the exterior part surrounding the openable cover.

6. The printing apparatus according to claim 1, wherein the displacement member includes an operation section which is operated to displace the displacement member, and the other includes a first movement regulation section that regulates movement of the operation section at a position in which the displacement member has been displaced to the locked position, and a second movement regulation section that regulates movement of the operation section at a position in which the displacement member has been displaced to the unlocked position.

7. The printing apparatus according to claim 1, wherein the displacement member includes an attachment section for attaching the regulation member that regulates movement of the displacement member to the unlocked position, and the attachment section is exposed when the displacement member is positioned at the locked position and at least part of the attachment section is housed in the other when the displacement member is positioned at the unlocked position.

8. The printing apparatus according to claim 7, wherein the attachment section is a pair of openings communicating each other through which the regulation member can be inserted.

9. A printing apparatus comprising:

a print section that performs printing on a medium;

a containing member that houses a print associated member which is associated with printing by the print section and is detachably mounted to an apparatus main body; and a lock mechanism that regulates pulling-out movement of the containing member, wherein the lock mechanism includes:

an insertion section disposed on one of the containing member and an exterior part surrounding the containing member; and a displacement member disposed on the other, and configured to move between a locked position in which the displacememnt member is inserted into the insertion section to regulate the pulling-out movement of the containing member and an unlocked position in which the displacement member disengages from the insertion section to permit the pulling-out movement of the containing member, and the displacement member includes an attachment section for attaching the regulation member that regulates movement of the displacement member to the unlocked position, and the attachment section is exposed when the displacement member is positioned at the locked position and at least part of the attachment section is housed in the other when the displacement member is positioned at the unlocked position.

* * * * *